United States Patent [19]
Keller
[11] 4,275,540
[45] Jun. 30, 1981

[54] PLASTIC FREE STANDING BRICK WALL SECTION

[75] Inventor: William A. Keller, St. Louis, Mo.
[73] Assignee: Keller Manufacturing Co., Inc., St. Louis, Mo.

[21] Appl. No.: 13,317
[22] Filed: Feb. 21, 1979
[51] Int. Cl.[3] ..... E04C 1/10; E04D 19/00
[52] U.S. Cl. ..... 52/314; 52/585
[58] Field of Search ..... 52/314, 585, 218

[56] References Cited

U.S. PATENT DOCUMENTS

| | | | |
|---|---|---|---|
| 1,527,723 | 2/1925 | Woodard | 52/218 X |
| 1,584,379 | 5/1926 | Kelley | 52/314 |
| 1,665,442 | 4/1928 | Campbell | 52/314 |
| 2,038,967 | 4/1936 | Strong | 52/314 |
| 2,096,265 | 10/1937 | Strong | 52/314 |
| 2,592,634 | 4/1952 | Wilson | 52/314 |
| 2,931,130 | 4/1960 | Rietz | 52/314 |
| 3,002,322 | 10/1961 | Dorsett | 52/314 |
| 3,025,640 | 3/1962 | Muhr | 52/585 |
| 3,690,076 | 9/1972 | Harris | 52/314 |
| 4,031,678 | 6/1977 | Schuring | 52/314 |

FOREIGN PATENT DOCUMENTS

| | | | |
|---|---|---|---|
| 249577 | 7/1946 | Switzerland | 52/585 |

*Primary Examiner*—John E. Murtagh
*Attorney, Agent, or Firm*—Glenn K. Robbins

[57] ABSTRACT

A plastic simulated brick wall free standing section adapted to be connected to other sections to form a brick wall.

The plastic sections are of a open box-like structure having a simulated brick wall front. The sections are comprised of an even number of staggered tiers in which the tiers alternate in length to provide overlapping or overhanging bricks staggered between adjacent tiers one-half brick. In this fashion the sections may be inverted with respect to one another and interlocked and connected together by a pin passing through the overhanging end sections to lock the intertwined and interlocked sections together. A cap stone is provided at both the top and the bottom and extends forwardly from the front brick simulated wall a short distance so that when the sections are placed on the ground they provide a greater degree of stability while providing a pleasing appearance through the top cap stone. A closure panel may be provided at the rear having a simulated brick and mortar appearance to close the open portion of the box-like structure and provide a complete brick wall appearance of increased stability.

4 Claims, 14 Drawing Figures

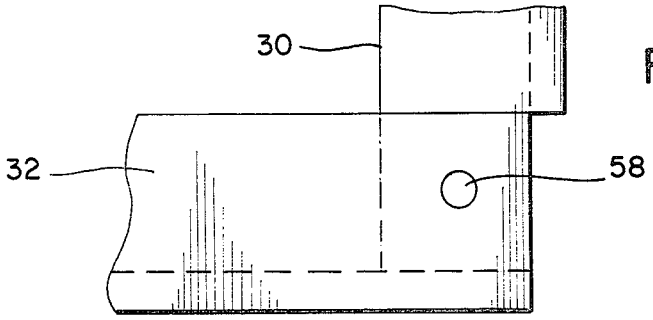
FIG. 7
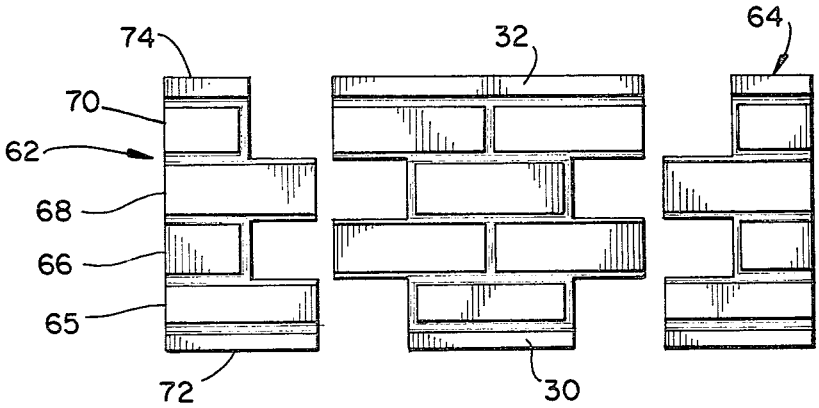
FIG. 8
FIG. 9
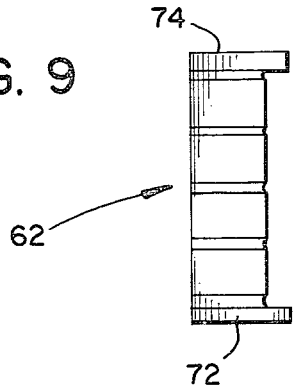
FIG. 10
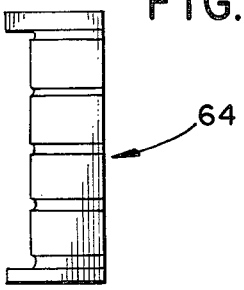
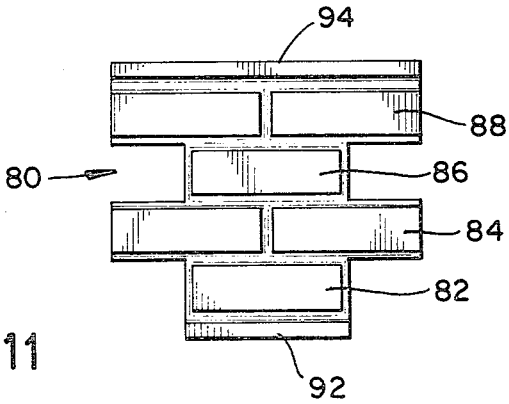
FIG. 11

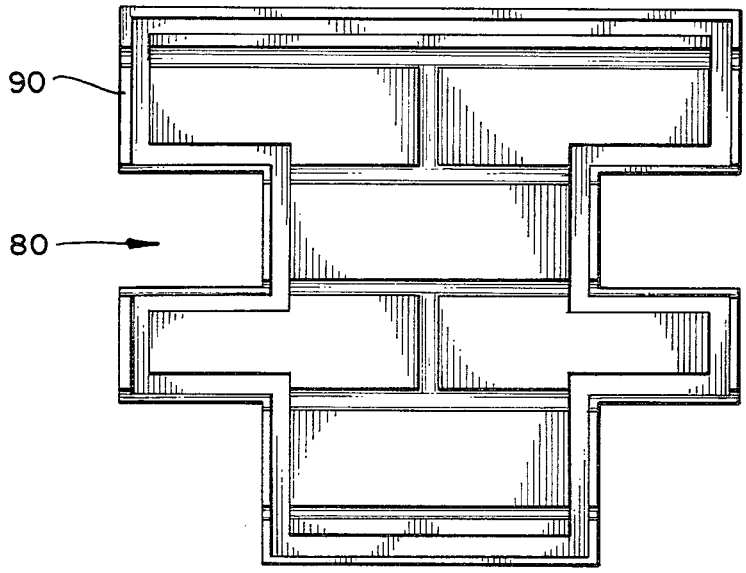
FIG. 12
FIG. 14
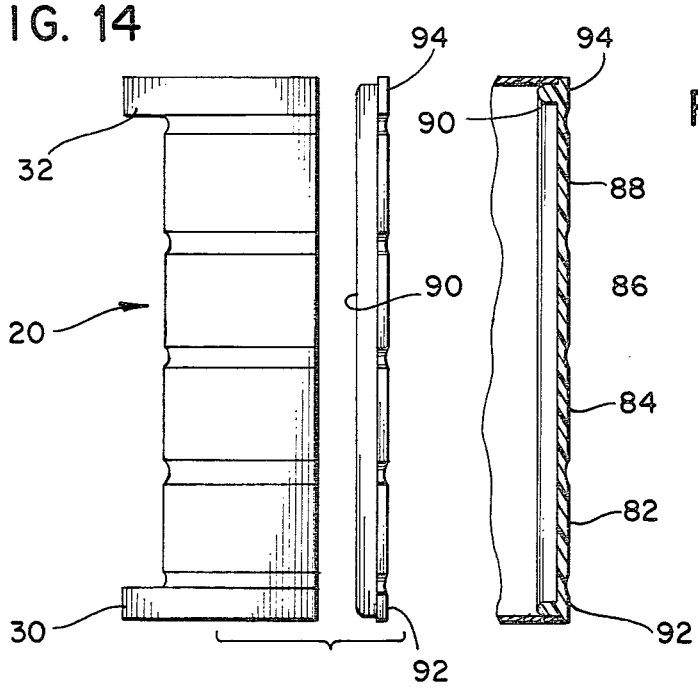
FIG. 13

PLASTIC FREE STANDING BRICK WALL SECTION

SUMMARY OF THE INVENTION

Brick walls with cap stones have long been provided as decorative and protective borders or barriers. Such brick walls are conventionally formed of alternate and staggered tiers of bricks of conventional construction with mortar in between. The bricks conventionally overlie one another a half brick and are staggered vertically. Cap stones likewise have been conventionally employed at the top of brick walls to provide decorative appearance and also to provide an overlay for protective purposes. Such brick walls require a considerable amount of time and labor in the erection and construction and expense and are not portable.

By means of this invention there has been provided a rigid plastic simulated brick wall section of a box-like structure which can be erected with other sections to form a simulated brick wall. The sections have overhanging bricks in alternate tiers to provide an interlocking panel-like construction of adjacent sections which can be held together by means of a pin or the like driven through the overhanging brick portions of the adjacent sections. The pin may be driven into the ground to provide ground stability.

The rigid plastic box-like brick sections of this invention are further provided with cap stones both at the top and the bottom. The cap stone structure which overhangs the brick portions to the front a slight degree at both top and bottom provides not only a pleasing appearance but also through the ground engaging bottom portion of the brick section a greater lateral stability for greater ground support. The forward extension of the bottom cap stone further assists edging by moving the grass growth out from the brick portions of the wall by the measure of the overhang.

The plastic brick wall sections of this invention are of a portable hollow box-like construction having an even number of tiers, which for example may be four tiers. These tiers, simply for example, may be two bricks in length alternating with tiers of one brick. The tiers are alternated so that the first and third tiers have overhanging half brick portions. By this construction identical brick sections adjacent each other may be inverted and fitted into the overhanging portions and a pin driven through registering holes in the overhanging portions to hold the brick sections together.

Further by means of the hollow box-like construction the brick sections having the same dimension as conventional bricks may be interlocked at right angles with adjacent sections to form a corner. This "cornering" is made possible through the geometry of the normal brick which for purpose of example is of a conventional size such as eight inches long and four inches wide and two and one-half inches high.

To end a simulated brick wall using the brick sections of this invention, end sections may be employed where one end of the section has the overhanging alternate brick tiers and the other end has a vertical plane termination so that the end of the tiers alternate between full brick sections and half brick sections for either a left end or the right end termination.

For closing the open box-like structure of the brick sections, a rear closure panel may be employed. This panel has a facing with the alternate brick tiers and simulated mortar in between the means of inserting the panel in the open rear of the brick sections. The insertion of the panel not only provides a complete and pleasing appearance from the rear of the brick wall formed by the locking the sections together, but also provides for increased rigidity by closing the open box-like rear portion of the sections.

The above features are objects of this invention and further objects will appear in the detailed description which follows and will be otherwise apparent to those skilled in the art.

For the purpose of illustration of this invention there is shown in the accompanying drawings a preferred embodiment thereof. It is to be understood that these drawings are for the purpose of illustration only and that the invention is not limited thereto.

IN THE DRAWINGS

FIG. 7, is a top plan view showing the panels joining together in a corner section.

FIG. 8, is an exploded view on a reduced scale showing two end sections fitted to a main panel.

FIG. 9, is a view on a reduced scale in side elevation taken from the left side of the left end section.

FIG. 10, is a view on a reduced scale in side elevation taken from the right side of the right end panel.

FIG. 11, is a view in rear elevation on a reduced scale showing the exterior of the closure panel.

FIG. 12, is an enlarged view showing the interior of the closure panel.

FIG. 13, is a fragmentary view in vertical section showing the interfitting of the closure panel in the rear of the main section.

FIG. 14, is an exploded view in side elevation showing the fitting of the closure panel to the rear of the main section.

DESCRIPTION OF THE INVENTION

Figure 3:
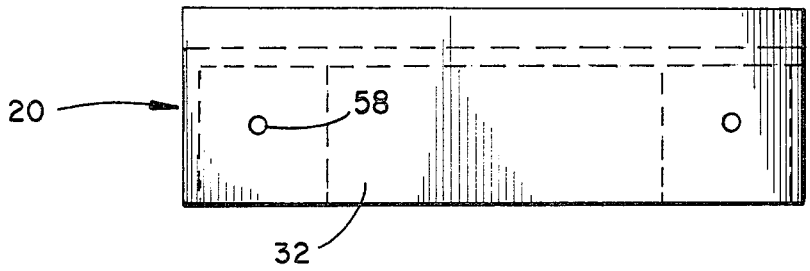
FIG. 3, is a bottom plan view of the panel.
Figure 2:
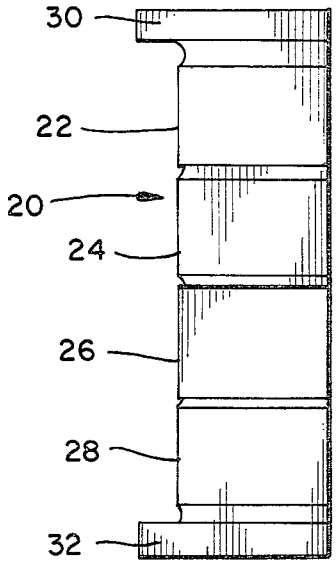
FIG. 2, is a view in side elevation of the panel taken on the right side of FIG. 1.
Figure 1:
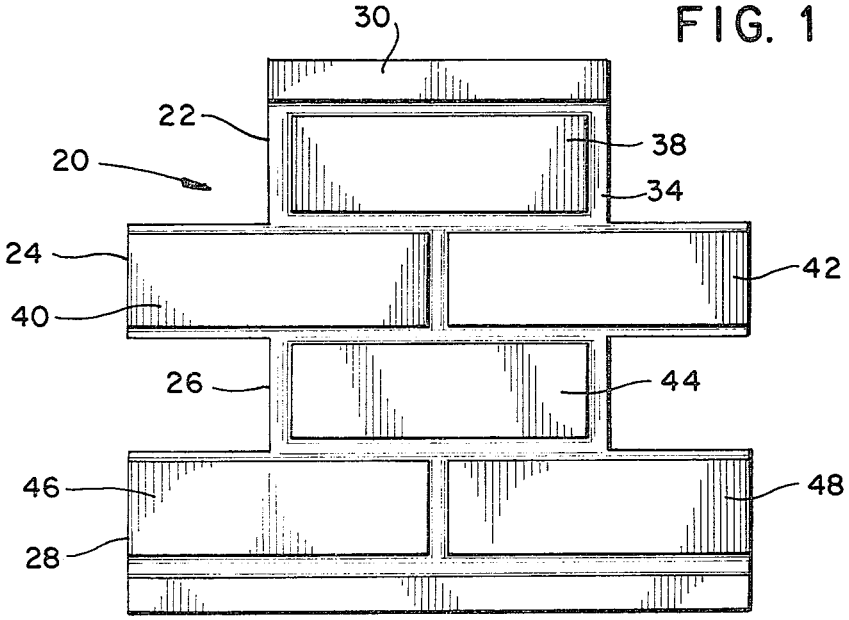
FIG. 1, is a view of front elevation of the panel.

The simulated brick wall section of this invention is generally identified by the reference numeral 20 in FIGS. 1 through 4. It is comprised of four tiers of bricks which are bounded by cap stone sections at both the top and the bottom. As shown in FIG. 1, a first tier or bricks 22, is followed by a second tier 24, third tier 26, and a fourth tier 28. A bottom cap stone 30 is provided at the bottom while a top cap stone section 32 is provided at the top. An interlay of mortar 34 encases each of the bricks and each of the brick sections as in a conventional brick structure.

Figure 4:
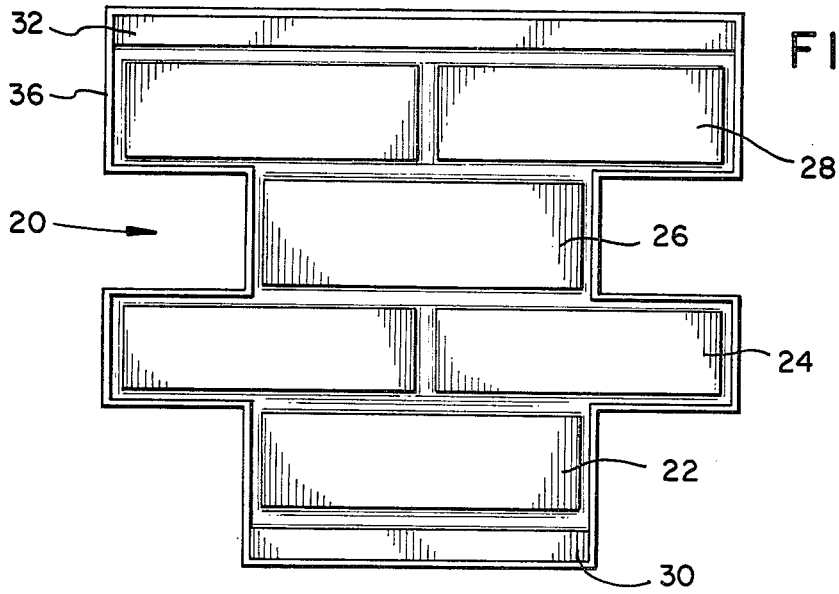
FIG. 4, is a view in rear elevation of the panel inverted.

The rear of the section as shown in FIG. 4, is open at 36 and there is provided a simulated brick wall section with an open rear portion.

The brick tiers are comprised of staggered bricks with respect to the adjacent tiers. Thus, in first tier 22 brick 38 is staggered with respect to the bricks 40 and 42 in the second tier. Likewise, brick 44 in the third tier is staggered with respect to the bricks 40 and 42 and bricks 46 and 48 in the tier 28. The individual bricks may be the same dimension as a conventional brick such as eight inches long, four inches wide and two and one-half inches high although it will be understood that this dimensioning may be changed if similar proportioning is employed. The proportioning is important when the sections are connected together at right angles as will more fully appear hereinbelow since proper registry, intertwining and interlocking is provided through the dimensioning of the brick sections of this invention.

Each of the brick sections has an end wall which extends to the rear four inches as in the usual brick. Thus, main section 20 is provided with a left end wall 52 and a right end wall 54, The end walls butt against one another as shown in the longitudinal sectional view of FIG. 5, where the ends are interlocked and abutted for joined sections to provide the connected wall structure of this invention.

Figure 5:
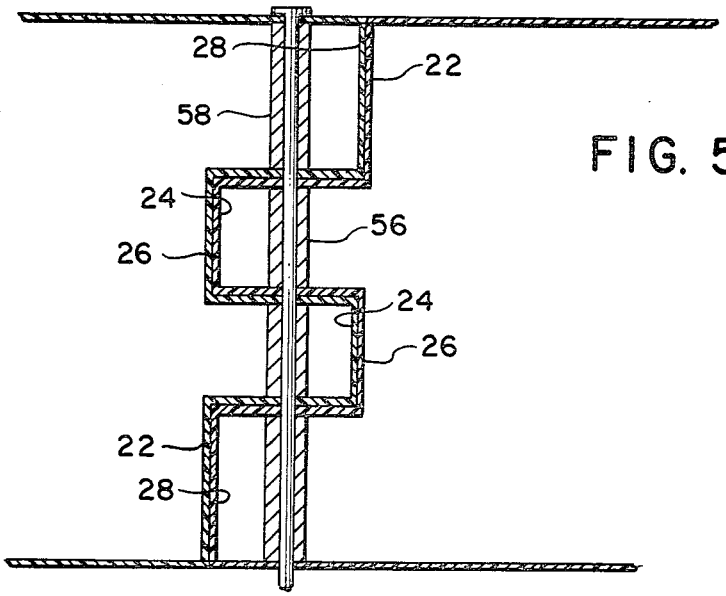
FIG. 5, is a view in longitudinal vertical section showing the means for fixing the interfitting panels together and into the ground.
Figure 6:
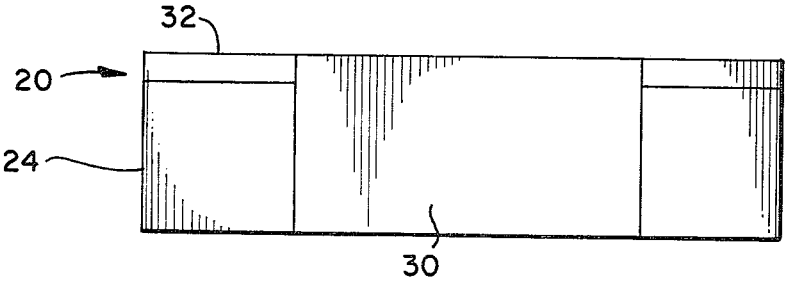
FIG. 6, is a top plan view of the main section.

To lock the particular brick sections together, a locking pin 56 as shown in FIG. 5 is employed. This pin is inserted through openings 58 provided in the overhanging portions of the bricks in the second and fourth tiers 24 and 28 as shown in FIG. 1. In the fitting together of adjacent sections, the sections are inverted with respect to each other as shown in FIG. 5. Pin 56 is adapted to be inserted through the mating and registering holes and driven into the ground to provide stability and anchoring of the connected together brick sections. Further, for stability and increased strength, ferrules or tubular reinforcing elements 60 may be inserted as shown in FIG. 5. These tubular elements provide for additional strength and they may be inserted when the pins are threaded through the openings to connect the interlocking ends of the connected brick sections or as desired may be cemented or cast in place in the sections. For registry and to accommodate the sections when they are connected together at right angles as shown in FIG. 7, the holes 58 in the overhanging brick portions are located one quarter the length of the brick and midway between the front and the rear of the brick section. This placement makes possible lining up and registry of the openings of the sections when they are placed end to end and also at right angles to one another as shown in FIG. 7.

Further, to provide for termination of the brick section where there is desired to end the free-standing brick wall structure in a straight line end sections are provided. Such end sections are shown in FIGS. 8, 9 and 10 as a left end section 62 and right end section 64. Each of the sections is comprised of alternate full and half brick sections or tiers. Thus, a first full brick tier 65 is followed by a half brick tier 66, a full brick tier 68 and a half brick tier 70 for the left end section 62. Cap stone sections 72 and 74 are also provided at the top and bottom. The left end is terminated in vertical wall 76. This vertical termination in a vertical plane is obviously desired for aesthetic purposes and also for stability. The right end section 64 is constructed in a similar but reverse fashion. Any of the brick wall sections may be terminated by the end sections regardless whether the bottom tier is a long or short tier. Adaptability for terminating the brick wall sections is provided through the use of either of the end sections 62 and 64. Each of the end brick sections 62 and 64 are provided with registering pin holes 58 as previously described for connection by the pin 56 and for anchoring to the ground as is apparent.

To close the open box-like rear portion of the brick wall sections, a rear closure panel 80 as shown in FIGS. 11, through 14, is provided. The panel is comprised of simulated brick tiers 82, 84, 86 and 88 just as the front portion of the main brick section 20 shown in FIGS. 1 through 4.

A rim or bead 90 or the like may be provided which fits within the rear walls of the brick section to provide a friction fit. It will also be apparent that cementing or sealing and other means may also be used as desired. The panel is also provided with the simulated cap stones 92 and 94 in order to provide a matching and pleasing appearance for the rear of the brick wall sections.

USE

The simulated brick wall sections of this invention are adapted to be used very simply and in the field by an average house owner. Thus, where the wall is desired to be laid out or erected, a first brick section 20 is simply placed on the ground in the manner shown in FIG. 1. Then an identical brick section is placed adjacent to it but is inverted such that the short length brick tier and cap stone brick is placed on the bottom and the long brick tier and cap stone is placed at the top. Then the brick sections are simply interfitted together. When so interfitted, the fastening pin 56 is inserted through the ferrules 60 placed in the overhanging or jutting out portions of the brick tiers. The pin is then simply threaded all the way through the brick sections and is driven into the ground. As many brick sections are used as desired.

Where it is desired to provide a corner structure, the brick sections are connected at right angles. This relationship is shown in FIG. 7, and the fastening or anchoring pin is then driven through the overhanging bricks to connect the brick sections and anchor them into the ground.

Where it is desired to terminate the brick wall in a straight vertical line, the end sections 62 and 64 may be simply used. Where the brick main section terminates as shown in FIG. 8, the section 62 may be simply connected to the left end of the main brick section 20 and fastened to it by an anchoring pin 56 as previously described. In like manner, the right end section 64 may be similarly connected to the right end. Where the brick main section terminates with a top tier as a single brick, it will be understood that the end section 64 may be used at the left end and the left end section 62 used at the right end. Adaptability is thus made possible regardless of how the main sections 20 terminate.

Where it is desired to use a rear closure panel, the rear panel 80 is simply inserted in the open box-like rear portion 36 of the main brick section. The panel is held in place by the bead or rim 90 which may be sealed or otherwise secured as desired. However, the friction fit normally may suffice to hold the panel in proper engagement.

By this invention there has accordingly been provided a rigid box-like simulated brick wall structure. This structure may be simply erected by the average house holder at a low cost and a minimum amount of time, without any special tools required other than a tool necessary to drive the pin or anchor 56 to the ground. The finished brick wall sections can be made as long as desired and can be terminated in straight end wall sections or can be connected at right angle as will be readily apparent. The structure provides substantial strength at a minimum cost to present an ornamental and pleasing brick wall appearance.

Various changes and modifications may be made within this invention as will be readily apparent to those skilled in the art. Such changes and modifications are within the scope and teaching of this invention as defined by the claims appended hereto.

What is claimed is:

1. A free standing modular simulated plastic brick section for mounting upon the ground or other base, said section comprising a rigid front wall having a plurality of vertically spaced tiers of brick facing members separated by mortar borders, said tiers being staggered vertically from adjacent tiers one-half brick, said section being integral and having top and bottom walls extending to the rear a distance at least about one-half brick, said bottom wall acting as a ground support, said section having end walls at opposite ends of the section extending to the rear to provide a rigid box-like structure open to the rear and means for joining adjacent sections in interlocking relation, vertically aligned openings being provided in said end walls at the opposite ends of each section which align vertically with an adjacent section and said joining means comprising pin means extending through said opening to join said adjacent sections and adapted to be driven into the ground, each section being comprised of an even number of tiers and adjacent sections being joined together in interlocking and abutting relations by said pin means, the individual sections being inverted with respect to one another.

2. The modular simulated brick sections of claim 1, in which said top and bottom walls form a front overhanging position extending to the rear of said section to provided ground stability when one of said walls is in ground engaging position.

3. The modular simulated brick sections of claim 1, in which a flat rigid panel is insertable in registry with said section from the rear to present a closed box-like structure of increased rigidity.

4. A free standing modular simulated plastic brick section for mounting upon the ground or other base, said section comprising a rigid front wall having a plurality of vertically spaced tiers of brick facing members separated by mortar borders, said tiers being staggered vertically from adjacent tiers one-half brick, said section being integral and having top and bottom walls extending to the rear a distance at least about one-half brick, said bottom wall acting as a ground support, said section having end walls at opposite ends of the section extending to the rear to provide a rigid box-like structure open to the rear and means for joining adjacent sections in interlocking relation, vertically aligned openings being provided in said end walls at the opposite ends of each section which align vertically with an adjacent section and said joining means comprising pin means extending through said opening to join said adjacent section and adapted to be driven into the ground, said sections being adapted to be fastened together in a rigid perpendicular corner, said end walls extending rearwardly a distance equal to one-half the length of an individual brick facing, said openings of the overlying end walls of the jutting out brick members being centered from the end one-quarter the length of an individual brick facing member to provide registry and vertical alignment of said openings for adjacent sections and said end wall of the overlying brick member having a brick facing at the corner exposing said end wall.

* * * * *